US008596992B2

(12) United States Patent
DeDecker et al.

(10) Patent No.: US 8,596,992 B2
(45) Date of Patent: Dec. 3, 2013

(54) AIR SUPPLY MECHANISM FOR VENTRICULAR ASSIST SYSTEM

(75) Inventors: Paul G. DeDecker, Clinton Township, MI (US); Paul S. Freed, Bloomfield Hills, MI (US)

(73) Assignee: L•VAD Technology, Inc., Plymouth, MI (US)

( * ) Notice: Subject to any disclaimer, the term of this patent is extended or adjusted under 35 U.S.C. 154(b) by 912 days.

(21) Appl. No.: 12/310,257

(22) PCT Filed: Aug. 17, 2007

(86) PCT No.: PCT/US2007/018276

§ 371 (c)(1),
(2), (4) Date: Dec. 22, 2009

(87) PCT Pub. No.: WO2008/021503

PCT Pub. Date: Feb. 21, 2008

(65) Prior Publication Data

US 2010/0111715 A1 May 6, 2010

Related U.S. Application Data

(60) Provisional application No. 60/838,902, filed on Aug. 18, 2006.

(51) Int. Cl.
*F04B 1/04* (2006.01)
*F04B 27/04* (2006.01)

(52) U.S. Cl.
USPC ..... 417/273; 417/269; 417/419

(58) Field of Classification Search
USPC ..... 417/234, 269, 271, 273, 412, 413.1
See application file for complete search history.

(56) References Cited

U.S. PATENT DOCUMENTS

| | | | | | |
|---|---|---|---|---|---|
| 1,508,805 | A | | 9/1924 | Shaw et al. | |
| 1,820,883 | A | * | 8/1931 | Hueber | 417/273 |
| 2,252,757 | A | * | 8/1941 | Carlson | 417/273 |
| 2,285,215 | A | * | 6/1942 | Lotz | 417/234 |
| 2,668,004 | A | * | 2/1954 | Browne | 74/50 |
| 3,239,132 | A | | 3/1966 | Frank et al. | |
| 3,248,044 | A | * | 4/1966 | Parker | 417/372 |
| 3,527,550 | A | * | 9/1970 | Flynn et al. | 417/383 |
| 4,957,107 | A | | 9/1990 | Sipin | |
| 5,219,274 | A | * | 6/1993 | Pawlowski et al. | 417/213 |
| 5,326,233 | A | | 7/1994 | Mochizuli et al. | |
| 5,380,164 | A | * | 1/1995 | Fry et al. | 417/250 |
| 5,551,843 | A | * | 9/1996 | Hauser | 417/234 |
| 5,588,811 | A | | 12/1996 | Price | |
| 5,803,122 | A | * | 9/1998 | Theilmeier | 137/854 |

* cited by examiner

*Primary Examiner* — Peter J Bertheaud
(74) *Attorney, Agent, or Firm* — Rohm & Monsanto, PLC

(57) ABSTRACT

A pump system has a rotatory shaft and a rotatory drive arrangement coupled to the rotatory shaft for applying rotatory energy thereto. First through fourth pump arrangements are coupled to the rotatory shaft, each pump arrangement pumping a pulse of air during each rotation of the rotatory shaft, the first, second, third, and fourth pump arrangements pumping a corresponding pulse of air sequentially during each rotation of the rotatory shaft. The rotatory shaft has a first and second ends, and a central region therebetween where an electric motor is coaxially arranged. The first and third pump arrangements are coupled to the first end of the rotatory shaft, and the second and fourth pump arrangements are coupled to the second end of the rotatory shaft. Angularly displaced eccentric couplers couple the pump arrangements to the respective ends of the rotatory shaft.

12 Claims, 9 Drawing Sheets

Prior Art

*Prior Art*

Prior Art

Prior Art

AIR SUPPLY MECHANISM FOR VENTRICULAR ASSIST SYSTEM

CROSS-REFERENCE TO RELATED APPLICATIONS

This application is a US national stage filing under 35 U.S.C. §371 of International Application No. PCT/US2007/018276 filed on Aug. 17, 2007 and claims the benefit under 35 U.S.C. §119(e) of U.S. Provisional Patent Application Ser. No. 60/838,902 filed Aug. 18, 2006. The disclosures in these applications are incorporated herein by reference.

BACKGROUND OF THE INVENTION

1. Field of the Invention

This invention relates generally to pump systems, and more particularly, to a four-head diaphragm pump arrangement that is particularly suited for use in portable medical devices, such as a ventricular assist system.

2. Description of the Related Art

Ventricular assist devices are life sustaining systems that preferably are sufficiently portable to be carried by a patient without undue weight or bulk. Preferably, such a system should be powered by compressed air, notwithstanding that compressed air in such an application would require that a significant head pressure be overcome. Although other gases of lower density would function in this application with reduced head pressure, such would require the use of a compressed gas stored in heavy tanks to supply the implanted blood pump of the ventricular assist device. The preferred gas therefore it is filtered room air, as it is readily available in an unlimited supply, and provides the additional safety aspect to the patient of not requiring the use of tanks that can lose pressure or run empty at inopportune times.

An air pump for the ventricular assist device application needs to be compact, light in weight, low in vibration, and electrically efficient. In addition, it is highly desirable that the pump arrangement to be quiet in its operation, and particularly that the noise at the intake be maintained at a minimum to eliminate the need for cumbersome muffler systems. Intake air noise is a major contributor to overall sound output. Finally, it is essential that the pump arrangement to be reliable, and that it operate at reduced temperatures to achieve an extended lifespan. It is often desirable to maintain the maximum operating temperature of a device that will contact human skin to below 40° C.

It is, therefore, an object of this invention to provide a battery powered air pump arrangement that is suited for powering a portable ventricular assist device.

It is another object of this invention to provide an air pump arrangement that operates quietly and pneumatically efficiently.

It is also an object of this invention to provide an air pump arrangement that operates with minimal vibration.

It is a further object of this invention to provide an air pump arrangement that operates electrically efficiently.

It is additionally an object of this invention to provide an air pump arrangement that is reliable with redundant subsystems and can achieve powering of a ventricular assist device to a life-sustaining degree notwithstanding at least one subsystem failure.

It is yet a further object of this invention to provide an air pump arrangement that can achieve powering of a ventricular assist device to a heart rate of approximately 180 beats per minute.

It is yet an additional object of this invention to provide an air pump arrangement that can achieve low vibration powering of a ventricular assist device over a broad range of a heart rate, illustratively between approximately 40 to 180 beats per minute.

It is also another object of this invention to provide an air pump arrangement that can achieve inflation of a ventricular assist device in approximately 150 ms.

SUMMARY OF THE INVENTION

The foregoing and other objects are achieved by this invention which provides a pump arrangement having a rotatory shaft and a rotatory drive arrangement coupled to the rotatory shaft for applying rotatory energy thereto. There are additionally provided first, second, third, and fourth pump arrangements coupled to the rotatory shaft, each pump arrangement pumping a pulse of air during each rotation of the rotatory shaft, the first, second, third, and fourth pump arrangements pumping a corresponding pulse of air sequentially during each rotation of the rotatory shaft.

In one embodiment, the rotatory shaft has a first end, a second end, and a central region therebetween, and the rotatory drive arrangement includes an electric motor coaxially arranged about the central region of the rotatory shaft. The first and third pump arrangements are coupled to the first end of the rotatory shaft, and the second and fourth pump arrangements are coupled to the second end of the rotatory shaft. In addition, there is provided a first eccentric coupler for coupling the first and third pump arrangements to the first end of the rotatory shaft; and a second eccentric coupler for coupling the second and fourth pump arrangements to the second end of the rotatory shaft, the first and second eccentric couplers being angularly displaced on the rotatory with respect to each other.

In an advantageous embodiment of the invention, the first eccentric coupler arrangement has first and second eccentric portions angularly displaced with respect to one another for engaging with the first and third pump arrangements, respectively, and the second eccentric coupler arrangement has third and fourth eccentric portions angularly displaced with respect to one another for engaging with the second and fourth pump arrangements, respectively. In this manner, the first, second, third, and fourth pump arrangements pump a corresponding pulse of air at respective predetermined angular points during each rotation of the rotatory shaft. Further in accordance with this embodiment, the first, second, third, and fourth pump arrangements pump a respective pulse of air sequentially during each rotation of the rotatory shaft. In a highly advantageous embodiment, the first, second, third, and fourth pump arrangements pump a respective pulse of air sequentially every 90° during each rotation of the rotatory shaft.

In a specific illustrative embodiment of the invention, the first, second, third, and fourth pump arrangements each are respective ones of first, second, third, and fourth diaphragm pumps. Each of the first, second, third, and fourth diaphragm pumps has a respectively associated air inlet and a respectively associated compressed air outlet, and there is further provided a pneumatic coupling arrangement for coupling the respective air outlets of the first, second, third, and fourth diaphragm pumps to a combined compressed air outlet. Preferably, an outlet air capacity at the combined compressed air outlet is approximately between 2 liters/minute and 11 liters/minute at approximately 6 psi, and the rotatory drive arrangement consumes a maximum of approximately 1.45 Amps at 11 Volts (approximately 16 Watts).

In a further embodiment of the invention, each of the first, second, third, and fourth diaphragm pumps is provided with a diaphragm pump head arrangement, each diaphragm pump head arrangement having a respective inlet air diaphragm and a respective outlet air diaphragm.

In a particularly advantageous embodiment, the second, third, and fourth pump arrangements pump a respective pulse of air sequentially every 90° during each rotation of said rotatory shaft.

In one embodiment, the first, second, third, and fourth pump arrangements are arranged in opposed pairs of pump arrangements. The first and third pump arrangements form a first pair of pump arrangements, and the second and fourth pump arrangements form a second pair of pump arrangements.

In a preferred embodiment, the first, second, third, and fourth pump arrangements are arranged in substantially coplanar relation.

In accordance with a method aspect of the invention, there are provided the steps of:

coupling first, second, third, and fourth pump arrangements to a rotatory shaft each at a preselected angle; and rotating the rotatory shaft whereby each of the first, second, third, and fourth pump arrangements issues a pulse of compressed air at the preselected angle of rotation of the rotatory shaft.

In one embodiment, the step of coupling comprises the further step of orienting respective ones of first and second eccentric couplers in response to the preselected angles of at least two of the first, second, third, and fourth pump arrangements. In a further embodiment, the step of coupling comprises the further step of orienting respective ones of third and fourth eccentric couplers in response to the preselected angles of the remaining two of the first, second, third, and fourth pump arrangements.

There is provided in a further embodiment the step of combining the pulses of compressed air to form the stream of compressed air.

In a highly advantageous embodiment of the invention, the step of coupling comprises the step of coupling first, second, third, and fourth pump arrangements to a rotatory shaft each at a preselected angle that differs from that of the other pump arrangements, whereby the first, second, third, and fourth pump arrangements issue respective pulses of compressed air sequentially in response to the step of rotating. Preferably, the respective sequential pulses of compressed air are distributed symmetrically in response to the step of rotating, and may be distributed every 90° in response to the step of rotating.

BRIEF DESCRIPTION OF THE DRAWING

Comprehension of the invention is facilitated by reading the following detailed description, in conjunction with the annexed drawing, in which.

DETAILED DESCRIPTION

Figure 1:
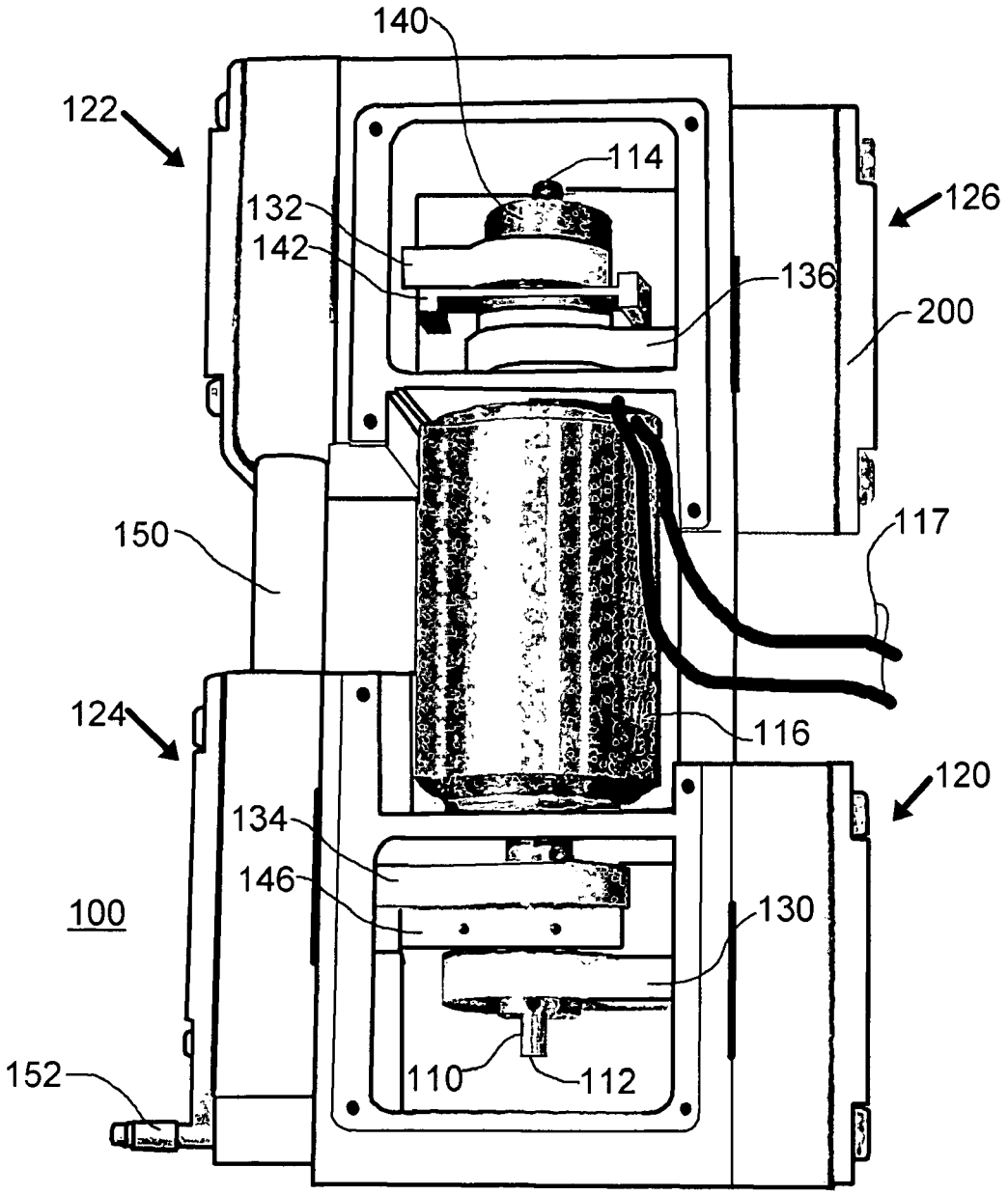
FIG. 1 is a plan view of a specific illustrative embodiment of the invention.

FIG. 1 is a plan view of a specific illustrative embodiment of a pump arrangement 100 constructed in accordance with the principles of the invention. Pump arrangement 100 is shown to have a rotatory shaft 110 having a first end 112 and a second end 114. An electric motor 116 is coaxially arranged about rotatory shaft 110 in a central region (not specifically designated) intermediate of first and second ends 112 and 114. The electric motor is powered via electric conductors 117.

Pump arrangement 100 is additionally provided with first through fourth pump arrangements that are respectively generally designated 120, 122, 124, and 126. Portions of a diaphragm head arrangement, such as that which is shown to be associated with pump arrangement 126, is designated as diaphragm head arrangement 200, and is further shown and described in connection with FIGS. 2 and 3, the operation of which is described in detain in connection with FIGS. 5-9.

Referring once again to FIG. 1, each of pump arrangements 120, 122, 124, and 126 is shown to be coupled to rotatory shaft 110 by a respectively associated one of connector rods 130, 132, 134, and 136. In this specific illustrative embodiment of the invention, each of the connector rods is coupled to rotatory shaft 110 by a respective eccentric coupler, as will be described below in connection with FIG. 4. The eccentric couplers are angularly displaced with respect to each other on the rotatory shaft, whereby in this specific illustrative embodiment of the invention each of pump arrangements 120, 122, 124, and 126 issues pulses of compressed air in a predetermined sequence as rotatory shaft 110 is rotated. In a highly advantageous embodiment, the eccentric couplers are angularly arranged such that the pulses of compressed air are issued each 90° of the rotation of rotatory shaft 110.

There is additionally shown in FIG. 1 a counterweight 140 that provides a balancing effect to pump arrangement 100 as rotatory shaft 110 is rotated. Preferably, a second counterweight is provided at the other end of rotatory shaft 110. However, the second counterweight is not shown in this figure to enhance the clarity of the present disclosure.

Support bearings 142 and 146, arranged on opposite ends of rotatory shaft 100 and intermediate of adjacent ones of the connector rods, provide additional support to the rotatory shaft. The support bearings are arranged to be affixed to top and/or bottom cover plates (not shown in this figure) that complete the enclosure of pump arrangement 100. In this embodiment, the pump arrangements are interconnected pneumatically, illustratively by conduits such as conduit 150, to produce a combined stream of compressed air at outlet 152.

As can be seen in FIG. 1, pump arrangements 120, 122, 124, and 126 are arranged in substantially coplanar relation. More specifically, pump arrangements 120 and 124 are arranged in opposition to one another, and pump arrangements 122 and 126 oppose one another in this substantially coplanar arrangement.

Figure 2:
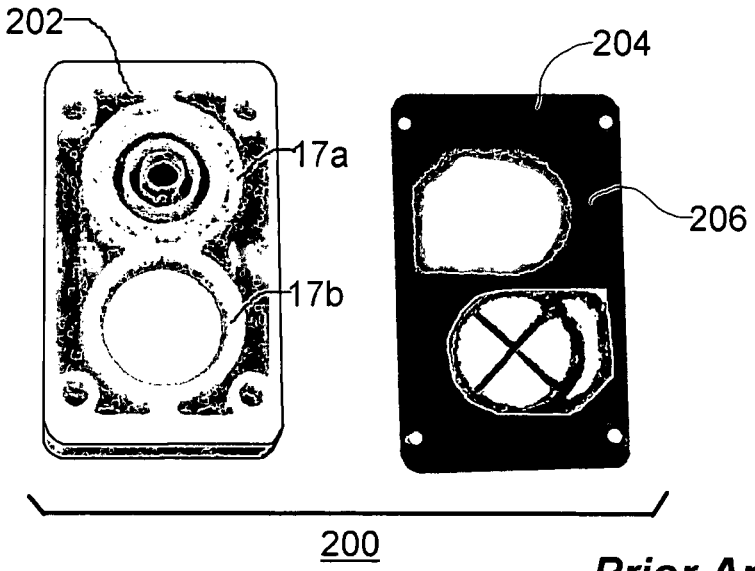
FIG. 2 is a plan view of elements of an illustrative prior art diaphragm head arrangement useful in the embodiment of FIG. 1.

FIG. 2 is a plan view of elements of an illustrative prior art diaphragm head arrangement 200 useful in the embodiment of FIG. 1. It is to be understood that the practice of the invention herein disclosed is not limited to the illustrative prior art diaphragm head arrangement shown in FIGS. 2-9 and described herein in connection with those figures. Referring to FIG. 2, there is shown a valve seat support 202 having thereon valve seats 17*a* and 17*b*. The valve seats and the diaphragms (not specifically designated) installed therein will be described in greater detail in connection with the schematic representations of FIGS. 5 and 6.

A valve seat cover arrangement 204 is shown to have a polymeric seal 204 installed thereon. Valve seat cover arrangement 204, when assembled with valve seat support 202, includes the polymeric seal interposed therebetween.

Figure 3:
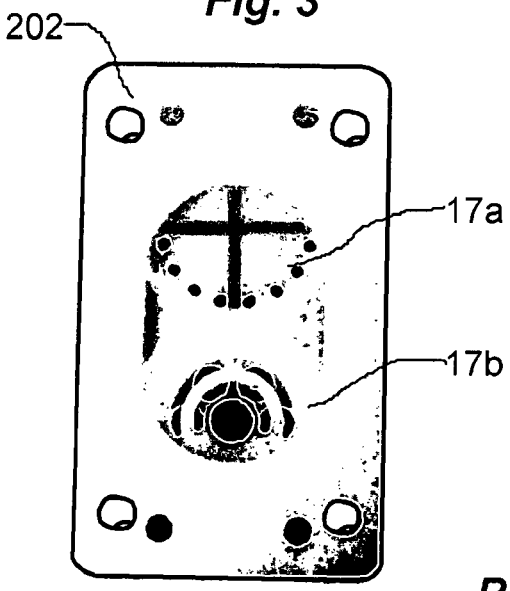
Prior Art Fig. 3
FIG. 3, is a plan view of the underside of one of the elements of the illustrative prior art diaphragm head arrangement shown in FIG. 1.

FIG. 3, is a plan view of the underside of valve seat support 202 of the illustrative prior art diaphragm head arrangement shown in FIG. 1. This figure shows the underside of valve seats 17*a* and 17*b*.

Figure 4:
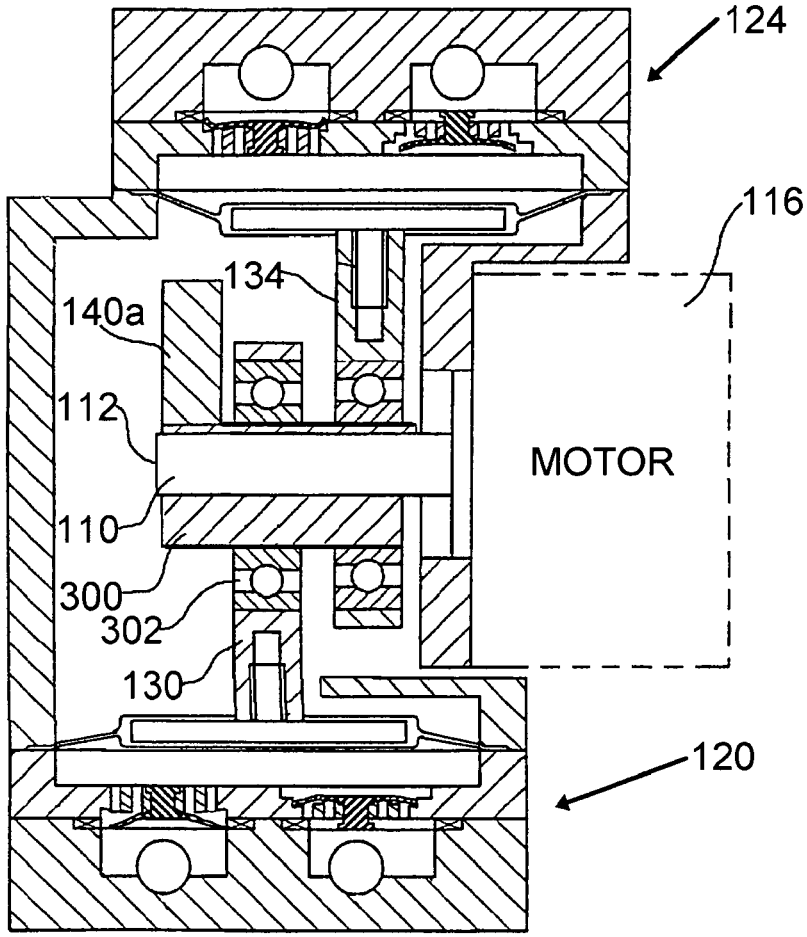
FIG. 4 is a schematic representation of the first and third pump arrangements coupled to the first end of the motor shaft that serves as the rotatory shaft.

FIG. 4 is a schematic representation of the first pump arrangement 120 and third pump arrangement 124 coupled to first end 112 of the rotatory shaft 110 that serves as the rotatory shaft. Elements of structure that have previously been discussed are similarly designated. In contrast to the embodiment described above in connection with FIG. 1, the present embodiment of FIG. 4 employs a single eccentric coupler 300 that is shared in this specific illustrative embodiment of the invention by connector rods 130 and 134. As shown, connector rods 130 and 134 are coupled to eccentric coupler 300 by respective bearings that are, in this embodiment, pressed onto the eccentric coupler and into the connector rods, such as bearing 302 associated with connector rod 130. A counterweight 140*a* serves to achieve a dynamic balance.

In the operation of the specific illustrative embodiment of FIG. 4, the sharing of eccentric coupler 300 by connector rods 130 and 134 results in the first and third pump arrangements operating 180° apart. That is, when the first pump arrangement is at top dead center, the third pump arrangement is at bottom dead center. Therefore, in embodiments of the invention where it is desired to operate pump arrangements 120, 122, 124, and 126 in sequence, the second eccentric coupler (not shown in this figure) disposed on the second end (not shown in this figure) of rotatory shaft 110 would be angularly displaced on the rotatory shaft to some angle other than 0° (parallel to the angular position of eccentric coupler 300) or 180° (diametrically opposite to the angular position of eccentric coupler 300). Installing the second eccentric coupler at a corresponding 90° or 270° would result in a four head pump arrangement that issues pulses of compressed air every 90° of the rotation of rotatory shaft 110.

Figure 5:
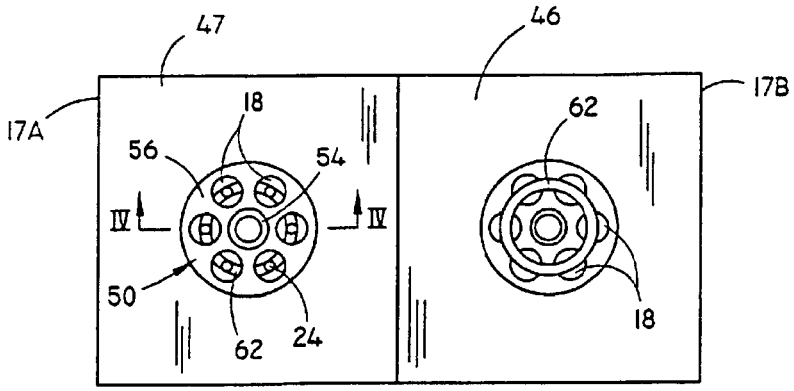
FIG. 5 is a schematic representation of a prior art diaphragm head arrangement useful in the embodiment of FIG. 1.
Figure 6:
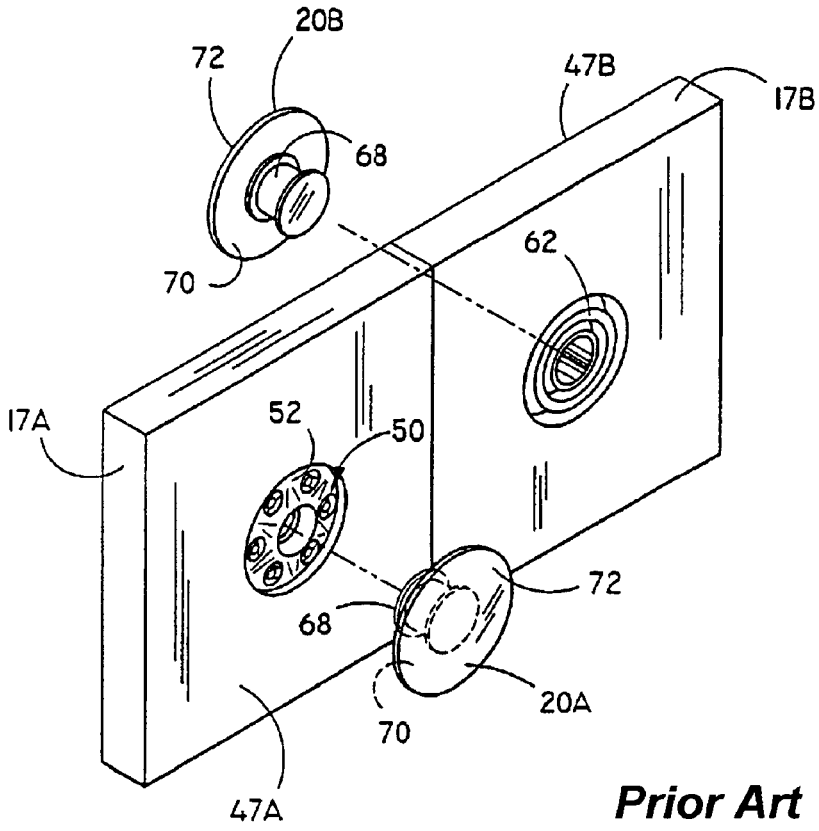
FIG. 6 is an isometric schematic representation of the prior art diaphragm head arrangement of FIG. 5.

FIG. 5 is a schematic representation of a prior art diaphragm head arrangement useful in the embodiment of FIG. 1. FIG. 6 is an isometric schematic representation of the prior art diaphragm head arrangement of FIG. 5. The operation of the prior art diaphragm head arrangement shown in FIGS. 5-9 is described in detail in U.S. Pat. No. 5,803,122, the disclosure of which is incorporated herein by reference. It is understood, however, that the present invention is not limited to the use of this known diaphragm head arrangement. Elements of structure that have previously been discussed in connection with FIGS. 2-4 are similarly designated.

Figure 7:
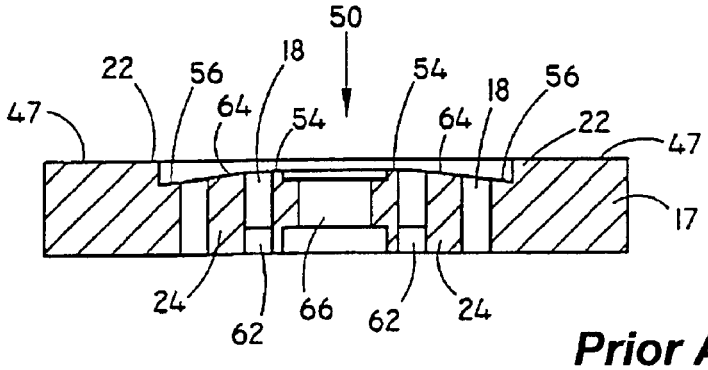
Prior Art Fig. 7
FIG. 7 is a partially cross-sectional representation of a prior art diaphragm employed in the prior art head arrangement of FIG. 6.

Referring to FIGS. 5 and 6, inlet and outlet valves 16*a* and *b* are each disposed in valve seats 17*a* and *b*, respectively, facing opposite directions. Because inlet and outlet valves 16*a* and *b* are identical in all respects except for their orientation in pump 10, description will be made of only one valve 16 which will be equally applicable to both FIG. 7 is a partially cross-sectional representation of a prior art diaphragm employed in the prior art head arrangement of FIG. 6. As shown in this figure, the interior of raised rim 22 defines a circular valve face 50 which is indented into a downstream side 47 of valve seat 17 from raised rim 22. In the preferred embodiment, valve face 50 has a frusto-conical shape made up of a central, circular, flat surface 54 which is surrounded by an angled, conical surface 56. Circular flat surface 54 is indented into valve seat 17 from raised rim 22 to bow diaphragm 20 as will be described in more detail below. The frusto-conical shape of valve face 50 is oriented so that angled conical surface 56 extends into valve seat 17 such that the depth of surface 56 is greatest at its outermost perimeter. Thus, valve face 50 is indented into valve seat 17 a maximum extent adjacent raised rim 22. While a frusto-conical shape is preferred, it will be understood that valve face 50 may have a variety of different shapes other than frusto-conical. For example, valve face 50 may not include a circular flat surface 54, but instead might solely include an angled, conical surface. As other alternatives, valve face 50 may be substantially planar, valve face 50 may be a curved concave shape, or valve face 50 may have a plurality of angled flat surfaces instead of angled, conical surface 56. It is contemplated that the most preferred configuration is any angled shape of valve face 50 wherein the depth of valve face 50 is greatest at its outermost perimeter. Such shapes support the diaphragm during the reverse cycle of fluid flow along a center area of valve face 50 which expands outwardly as the reverse fluid pressure is increased. Such shapes also substantially prevent diaphragm 20 from contacting valve face 50 at its deepest perimeter adjacent raised rim 22.

Figure 8:
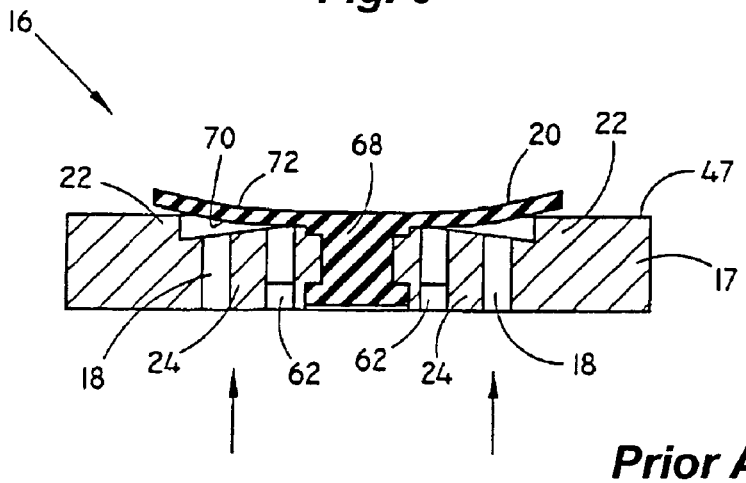
FIG. 8 is a partially cross-sectional representation of the prior art diaphragm employed in the prior art head arrangement of FIG. 6 shown in a closed position.

FIG. 8 is a partially cross-sectional representation of the prior art diaphragm employed in the prior art head arrangement of FIG. 6 shown in a closed position. A plurality of cylindrical channels 18 are defined in valve face 50 of valve seat 17. In the illustrated embodiment, six channels 18 are defined in valve seat 17 and are oriented to intersect angled, conical surface 56 of valve face 50 in a circular fashion. A center support 24 is axially oriented in the center of each channel 18. Center supports 24 include an angled downstream end 64 that is angled approximately the same as angled, conical surface 56 so as to lie generally in the same plane as that region of valve face so immediately adjacent channel 18. Center supports 24 are secured to valve seat 17 by a bridge ring 62 substantially concentric to circular valve face 50 and disposed adjacent an upstream side 46 of valve seat 17 (FIG. 8). Bridge ring 62 is thus removed from valve face 50. Center supports 24 are connected to bridge ring 62 upstream of angled downstream ends 64. Center supports 24 each provide a point of contact that support diaphragm 20 during the reverse cycle of fluid flow so that diaphragm 20 is not excessively deformed across channels 18. The support provided by supports 24 enables diaphragm 20 to be made thinner than that which could otherwise span channels 18 without being drawn down into channels 18 on the reverse stroke, and thus provide sufficient durability to repeated high speed cycling of the valve 10. The thinness of diaphragm 20 also decreases power consumption and speeds response time. In the preferred embodiment, center supports 24 have a circular cross-sectional shape that is substantially concentric to the circular cross-sectional shape of channels 18. In an alternative embodiment, the span of bridge ring 62 across each channel 18 is recessed into the inlet plenum or chamber in order to reduce constriction at the entry into channels 18.

A plug recess 66 is defined in valve seat 17 in the center of valve face 50 (FIGS. 5-7). Plug recess 66 is surrounded concentrically by flat surface 54 of valve face 50. Plug recess 66 is shaped to securely receive a plug 68 on diaphragm 20. When diaphragm 20 is secured to valve seat 17 via the securing of plug 68 in plug recess 66, an upstream surface 70 of diaphragm 20 extends over all of valve face 50, including channels 18 therein, and onto and beyond raised rim 22. Because diaphragm 20 is secured to valve seat 17 in a position indented from raised rim 22, diaphragm 20 is bowed by its contact with raised rim 22. The bowing of diaphragm 20 biases diaphragm 20 toward a closed position, i.e. a position where upstream surface 70 of diaphragm 20 contacts and is fluidly sealed near its perimeter against raised rim 22. The bowing of diaphragm 22 gives valve 16 a better response characteristic by snapping closed more quickly upon a drop in forward fluid pressure (i.e. during the return stroke). This characteristic is especially important in a high-speed reciprocating environment.

Figure 9:
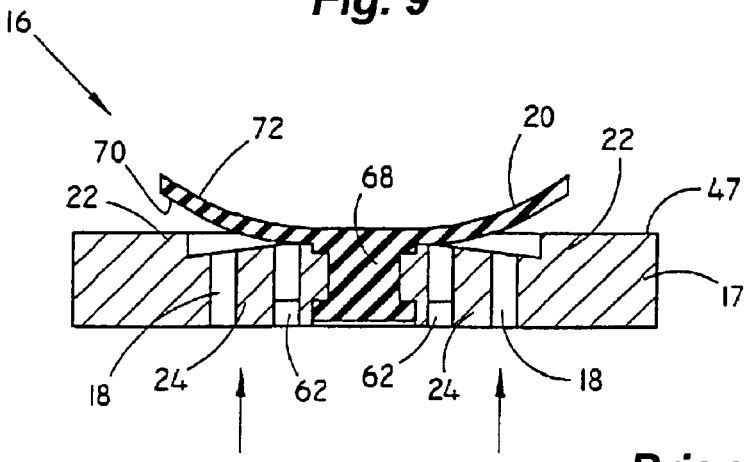
Prior Art Fig. 9
FIG. 9 is a partially cross-sectional representation of the prior art diaphragm employed of FIG. 8 shown in an open position.

FIG. 9 is a partially cross-sectional representation of the prior art diaphragm employed in the embodiment of FIG. 8, shown in an open position. When pump 10 is shut off and valve 16 is in a rest position, upstream surface 70 of diaphragm 20 is spaced a small distance away from angled downstream ends 64 of center supports 24. Only during the return stroke of pump 10, when the fluid pressure is greater on a downstream surface 72 of diaphragm 20 than upstream surface 70, will diaphragm 20 contact center supports 24, and then typically only along a portion. The space between diaphragm 20 and center supports 24 allows the fluid upstream of diaphragm 20 to exert pressure against upstream surface 70 of diaphragm 20 over a greater area than would otherwise be possible without this space. With the fluid exerting pressure over a greater area, diaphragm 20 will experience a greater forward opening force during the forward cycle, and less pressure will therefore be required to open valve 16. Consequently less energy will be consumed by valve 16 and a faster response time will be produced.

Diaphragm 20 is made of a pliable yet durable material in order to require minimal energy to open and yet withstand the pressures of a high-speed environment. Resilient, elastomeric materials are suitable, and in the preferred embodiment diaphragm 20 is made of neoprene. Alternatively diaphragm 20 may be made of Latex, Silicone, Buna-N, EPDM, Viton, or other suitable resilient elastomeric material.

During the return fluid cycle, valve 16 will be closed and pushed against a portion of downstream ends 64 of center supports 24. Because of the frusto-conical shape of surface 52 in combination with raised rim 22, diaphragm 20 will not contact all of the frusto-conical surface of valve face 50 nor necessarily all of downstream ends 64 of center supports 24. The area of upstream surface 70 of diaphragm 20 against which the fluid can exert pressure will therefore be greater than the sum of the cross-sectional areas of channels 18 (minus the center support cross-sectional areas). Consequently, less energy will be consumed to crack open valve 16 from a reverse cycle position. It can therefore be seen that valve 16 is both energy efficient and durable as a result of its unique configuration.

While the prior art diaphragm valve arrangement described herein finds applicability in valves having a range of dimensions, the relative dimensions of valve 16 in one embodiment of a 15 liters per minute valve are as follows: the diameter of diaphragm 20 is 0.687 inches; diaphragm 20 has a thickness of 0.017 inches; the diameter of valve face 50 is 0.625 inches; the depth of raised rim 22 is 0.021 inches; the diameter of channels 18 is 0.156 inches; the diameter of center supports 24 is 0.063 inches; and the diameter of bridge ring 62 is 0.405 inches.

Figure 10:
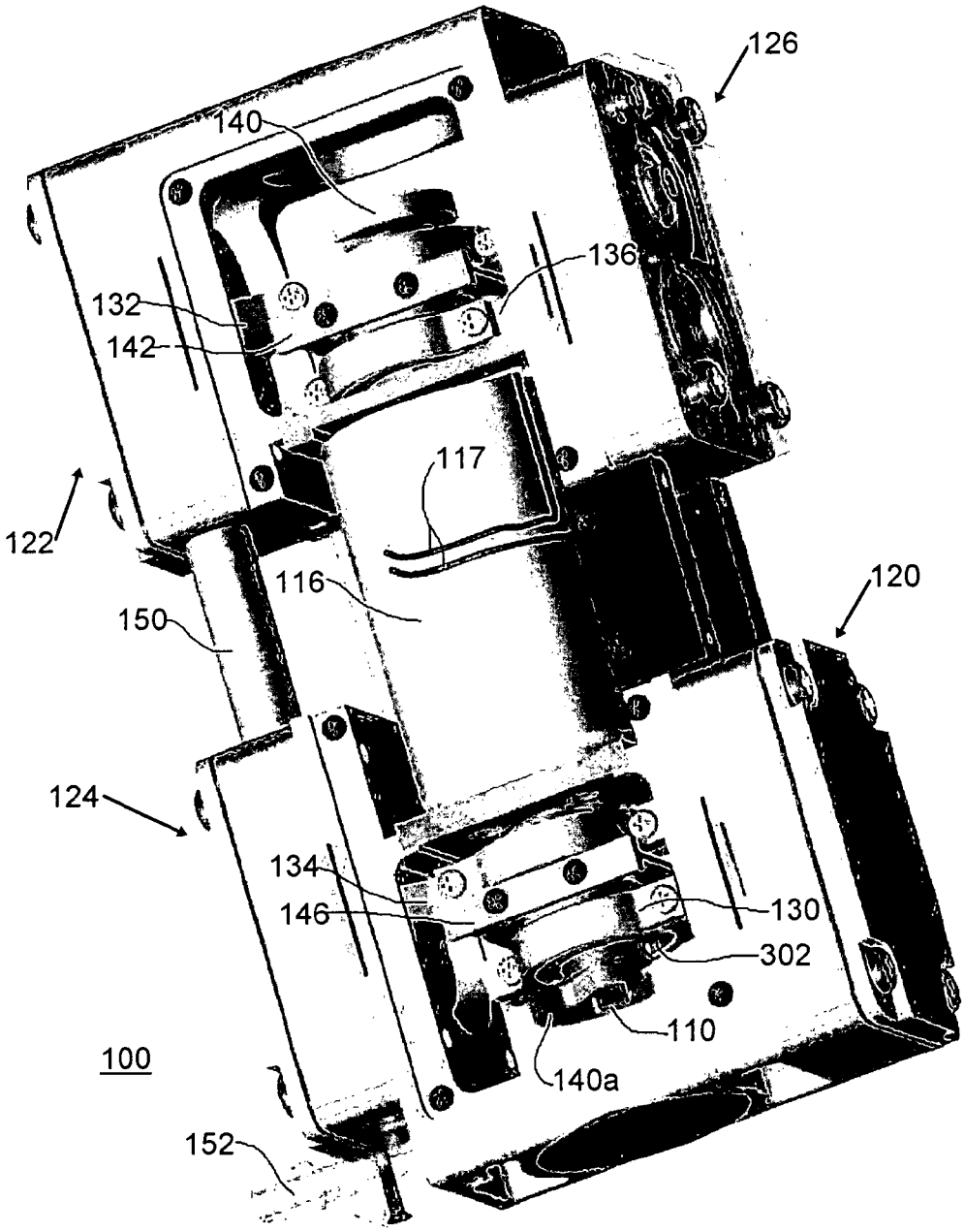
FIG. 10 is a partially fragmented and partially transparent perspective representation of a four-head pump arrangement constructed in accordance with the principles of the invention.

FIG. 10 is a partially fragmented and partially transparent perspective representation of a four-head pump arrangement constructed in accordance with the principles of the invention. Elements of structure that have previously been discussed are similarly designated. As shown in this figure, connector rod 130 has bearing 302 installed therein. The embodiment of FIG. 10 is similar to that of FIG. 1 in that each connector rod has an associated eccentric coupler (not shown in this figure) whereby the specific angle of rotation of the rotatory shaft at which each pump arrangement will issue a pulse of compressed air can individually be preselected.

Figure 11:
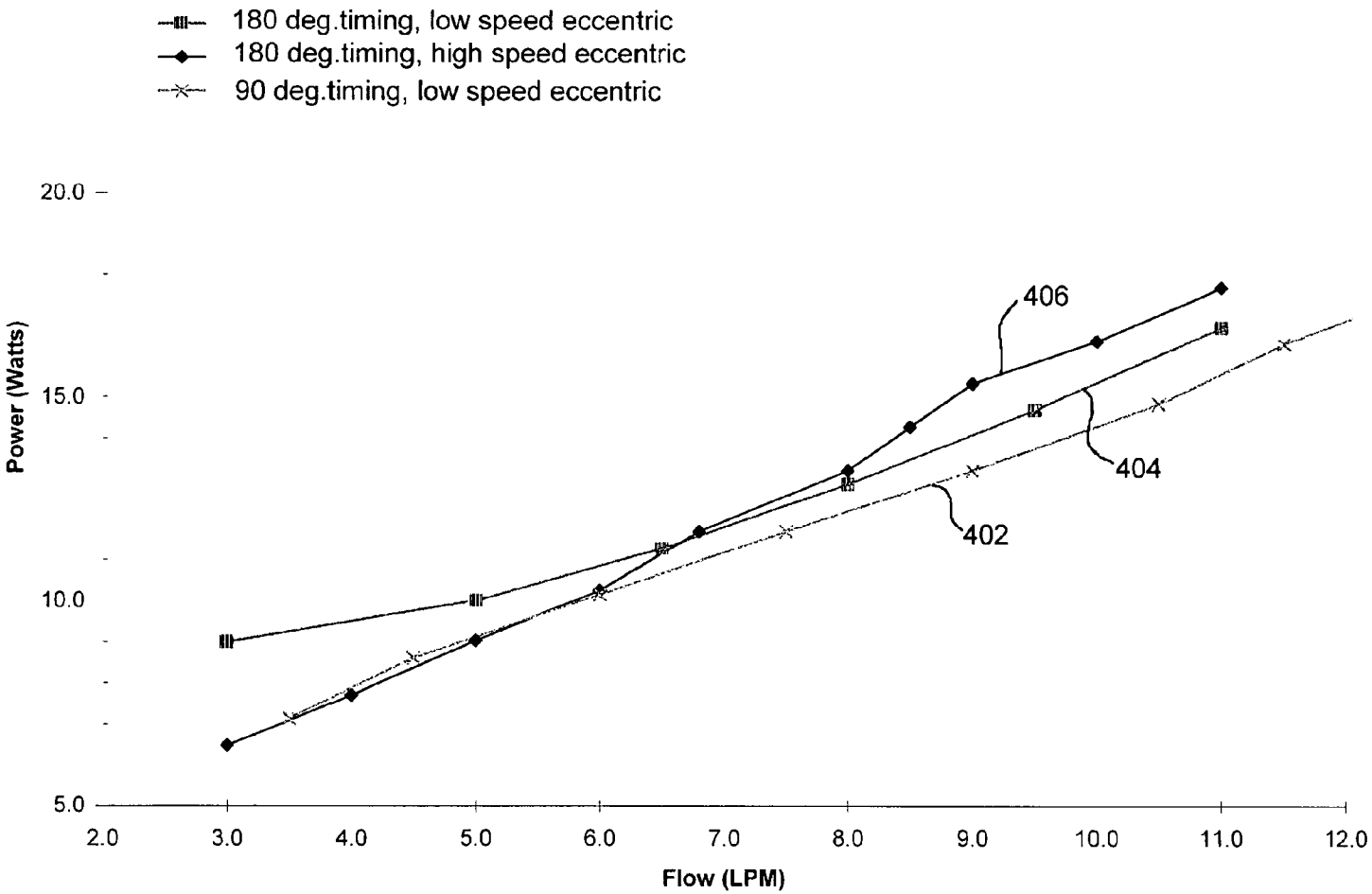
FIG. 11 is a graphical representation that compares pump flow versus power consumption for various pump configurations, including the specific illustrative embodiment of the invention described herein.

FIG. 11 is a graphical representation that compares pump flow versus power consumption for various pump configurations, including the specific illustrative embodiment of the invention described herein. As shown in this figure, the four head design of the present specific illustrative embodiment of the invention (not shown in this figure), which employs a 90° air pulse timing, as described above, exhibits reduced power consumption as compared to four head designs that employ 180° air pulse timing. More specifically, graph trace 402, which corresponds to the four head design of the present specific illustrative embodiment of the invention, using 90° timing and low speed eccentric, consumes less power at almost all flow rates (graphical trace 404) than a high speed eccentric (graphical trace 406). In addition, the 90° timing achieves reduced noise and low vibration. The term "low speed eccentric," as used herein refers to a stroke length design that is longer than the stroke length of the high speed eccentric, and therefore can be rotated at a slower speed. The stroke length refers to the offset from the centerline of the piston bearing assembly, which determines the length of the stroke. Lower speeds tend to vibrate more, but run quieter.

Figure 12:
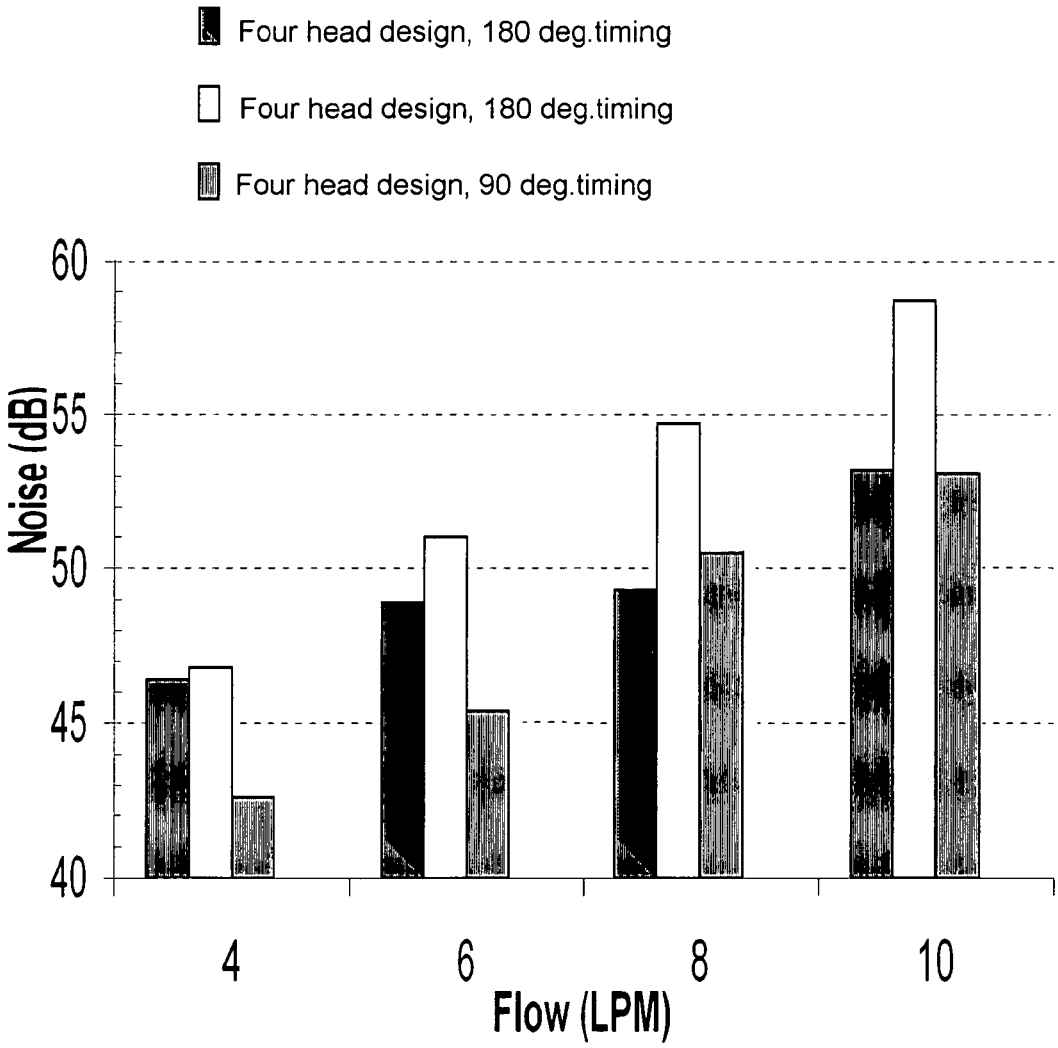
FIG. 12 is a bar graph representation that compares output flow versus noise level output for various pump configurations, including the specific illustrative embodiment of the invention described herein.

FIG. 12 is a bar graph representation that compares output flow versus noise level output for various pump configurations, including the specific illustrative embodiment of the invention described herein. As shown in this figure, the four head design of the present specific illustrative embodiment of the invention (not shown in this figure), which employs a 90° air pulse timing, exhibits reduced noise output at each of several flow rates, as compared to the four head design (not shown) operated using a high speed eccentric. The noise output is comparable to that of the four head design (not shown) operated using a low speed eccentric.

Although the invention has been described in terms of specific embodiments and applications, persons skilled in the art may, in light of this teaching, generate additional embodiments without exceeding the scope or departing from the spirit of the invention described and claimed herein. Accordingly, it is to be understood that the drawing and description in this disclosure are proffered to facilitate comprehension of the invention, and should not be construed to limit the scope thereof.

What is claimed is:

1. A pump arrangement comprising:

a rotary shaft having a first end, a second end, and a central region therebetween;

a rotary drive arrangement coupled to said central region of said rotary shaft for applying rotary energy thereto;

first, second, third, and fourth connector rods coupled to said rotary shaft, each for converting the rotary energy of said rotary drive arrangement to linear motion along a respectively associated one of first, second, third, and fourth axes of motion, each such axis of motion being orthogonal to said rotary shaft;

first, second, third, and fourth pump arrangements coupled to respectively associated ones of said first, second, third, and fourth connector rods, each of said first, second, third, and fourth pump arrangements pumping a pulse of air during each rotation of said rotary shaft, said first, second, third, and fourth pump arrangements pumping the corresponding pulse of air sequentially during each rotation of said rotary shaft;

a first eccentric coupler arrangement for coupling said first and third connector rods to said first end of said rotary shaft, said first eccentric coupler arrangement having first and second eccentric portions angularly displaced with respect to one another for engaging with said first and third connector rods, respectively; and a second eccentric coupler arrangement for coupling said second and fourth connector rods to said second end of said rotary shaft, said first and second eccentric coupler arrangements being angularly displaced on said rotary shaft with respect to each other, said second eccentric coupler arrangement having third and fourth eccentric portions angularly displaced with respect to one another for engaging with said second and fourth connector rods, respectively.

2. The pump arrangement of claim 1, wherein said rotary drive arrangement comprises an electric motor coaxially arranged about said central region of said rotary shaft.

3. The pump arrangement of claim 1, wherein said first, second, third, and fourth pump arrangements pump said corresponding pulse of air at respective predetermined angular points during each rotation of said rotary shaft.

4. The pump arrangement of claim 3, wherein said first, second, third, and fourth pump arrangements pump said corresponding pulse of air sequentially every 90° during each rotation of said rotary shaft.

5. The pump arrangement of claim 1, wherein said first, second, third, and fourth pump arrangements are arranged in opposed pairs of pump arrangements.

6. The pump arrangement of claim 5, wherein said first and third pump arrangements form a first pair of pump arrangements, and said second and fourth pump arrangements form a second pair of pump arrangements.

7. The pump arrangement of claim 5, wherein said first, second, third, and fourth pump arrangements are arranged in substantially coplanar relation.

8. The pump arrangement of claim 1, wherein said first, second, third, and fourth pump arrangements each are respective ones of first, second, third, and fourth diaphragm pumps.

9. The pump arrangement of claim 8, wherein each of said first, second, third, and fourth diaphragm pumps has a respectively associated air inlet and a respectively associated compressed air outlet, and there is further provided a pneumatic coupling arrangement for coupling said respective air outlets of said first, second, third, and fourth diaphragm pumps to a combined compressed air outlet.

10. The pump arrangement of claim 9, wherein an outlet air capacity at said combined compressed air outlet is approximately between 2 liters/minute and 11 liters/minute at approximately 6 psi.

11. The pump arrangement of claim 10, wherein said rotary drive arrangement consumes approximately 1.45 Amps at 11 Volts.

12. The pump arrangement of claim 8, wherein each of said first, second, third, and fourth diaphragm pumps is provided with a diaphragm pump head arrangement, each diaphragm pump head arrangement having a respective inlet air diaphragm and a respective outlet air diaphragm.

* * * * *